US005519898A

United States Patent [19]

Guo et al.

[11] Patent Number: 5,519,898

[45] Date of Patent: May 28, 1996

[54] BIDIRECTIONAL TWO-VOLUME FLUSH CONTROL MECHANISM FOR TOILETS

[76] Inventors: Jeng-Yeou Guo; Shyan-Dyi Guo, both of No. 218-8, Sec. 4, Fu-Hsing Rd., Taichung, Taiwan

[21] Appl. No.: 373,750

[22] Filed: Jan. 17, 1995

[51] Int. Cl.[6] ..... E03D 3/12

[52] U.S. Cl. ..... 4/325

[58] Field of Search ..... 4/324, 325, 381–386

[56] References Cited

U.S. PATENT DOCUMENTS 4,411,029 10/1983 Huang ..... 4/324

4,485,501 12/1984 Kloner ..... 4/324

4,881,279 11/1989 Harney ..... 4/325 X

*Primary Examiner*—Charles E. Phillips

*Attorney, Agent, or Firm*—Bacon & Thomas

[57] ABSTRACT

A bidirectional two-volume flush control mechanism which permits a part of the water to be suddenly driven out of the water tank when the trip handle is pulled upwards and, which permits the whole volume of the water to be completely driven out of the water tank when the trip handle is pushed downwards to move an actuating rod over a roller, which is mounted on the top end of a cylindrical float that is coupled to a swivel rod.

2 Claims, 6 Drawing Sheets

BIDIRECTIONAL TWO-VOLUME FLUSH CONTROL MECHANISM FOR TOILETS

BACKGROUND OF THE INVENTION

The present invention relates to flush control mechanisms for toilets, and relates more particularly to a bidirectional two-volume flush control mechanism.

Conventional ballfloat toilets are commonly operated by a trip handle to lift the tank ball from the valve seat through lift wires. When the tank ball is lifted from the valve seat, it will fall to close to the valve seat again only when the full volume of water is drawn away from the water tank. These ballfloat toilets are functional, however they waste much water because they cannot be controlled to discharge different volumes of water according to different situations.

SUMMARY OF THE INVENTION

The present invention has been accomplished to provide a bidirectional two-volume flush control mechanism which eliminates the aforesaid problem. According to the present invention, only a part of the water will be drawn out of the water tank when the trip handle is pulled upwards. When the trip handle is turned downwards to lift a tank ball from the valve seat through a link and a chain, a semi-circular member will be stopped by a cylindrical float to hold the link in the lifted position, permitting the water to be completely drawn out of the water tank. After the water has been drawn away from the water tank, the cylindrical float falls from the semi-circular member, causing the link to return to its former position, and therefore the tank ball again closes the valve seat.

DETAILED DESCRIPTION OF THE PREFERRED EMBODIMENT

Figure 1:
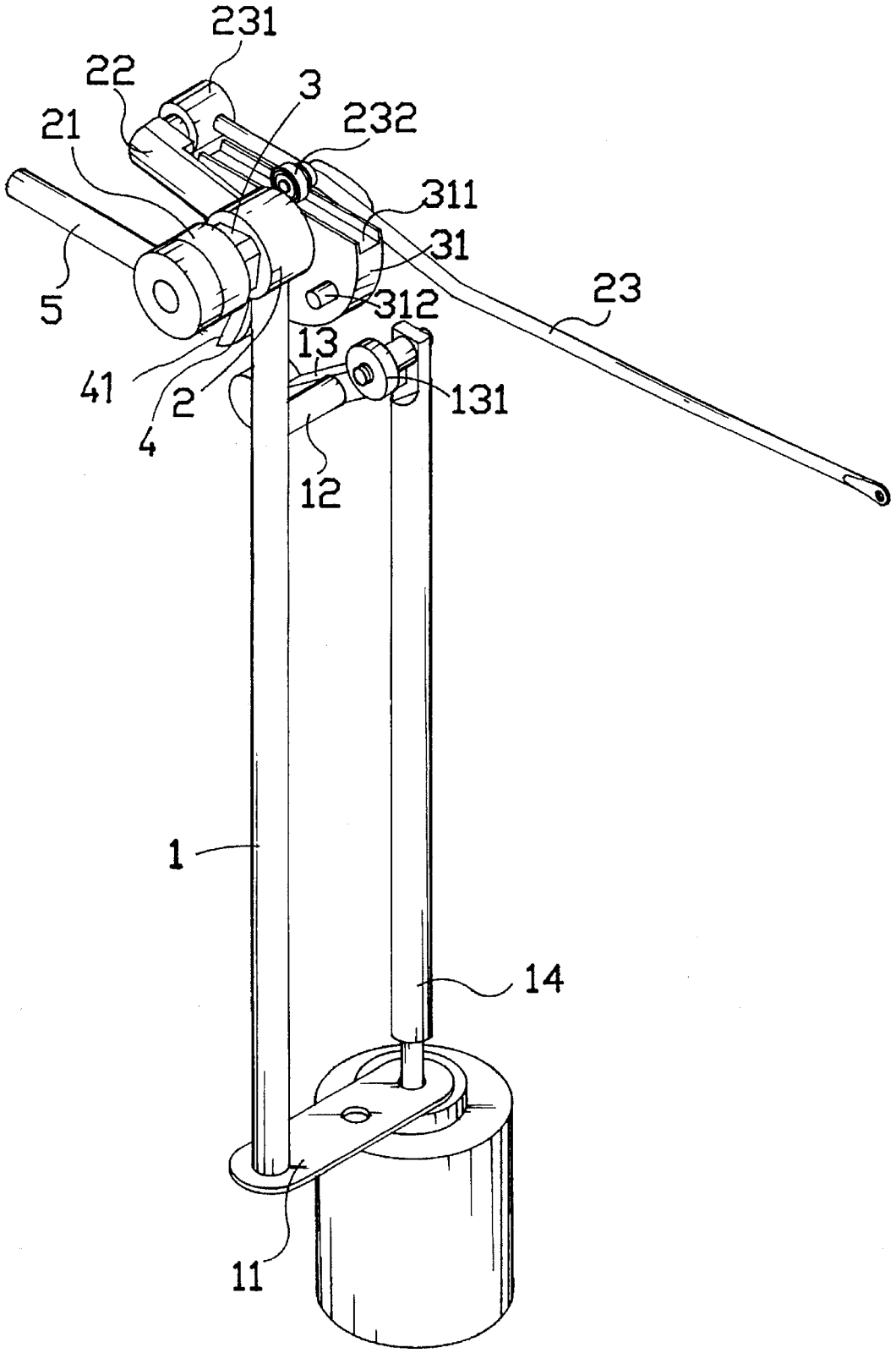
FIG. 1 is a perspective view of the bidirectional two-volume flush control mechanism according to the present invention.

Referring to FIG. 1, an upright post 1 is provided having a transverse bottom plate 11 at the bottom, and a peg 12 near the top end. A swivel rod 13 is pivotably connected to the free end of the peg 12, having one end terminating in a weight and an opposite end coupled to the top end of a cylindrical float 14 and mounted with a roller 131. The bottom end of the cylindrical float 14 is movably inserted into a hole on the transverse bottom plate 11. A barrel 2 is securely fixed to the top end of the upright post 1, having one end with a smaller outer diameter mounted with a water sealing ring 21 and an opposite end with a larger outer diameter coupled to an angle bar 22. The angle bar 22 has an opposite end coupled to a link 23. The link 23 has a socket 231 at one end connected to the angle bar 22, and a bearing 232 in the middle. A shaft 3 is provided having one end inserted through the barrel 2 and into a semi-circular member 31 in the middle. The semi-circular member 31 has a groove 311 along a chord, which receives the bearing 232 of the link 23, and two stop rods 312 and 312' at one lateral side. An actuating rod 4 is securely fixed to the semi-circular member 31, having a rounded actuating tip 41, which will push the roller 131 when the actuating rod 4 is turned by the semi-circular member 31.

Figure 2:
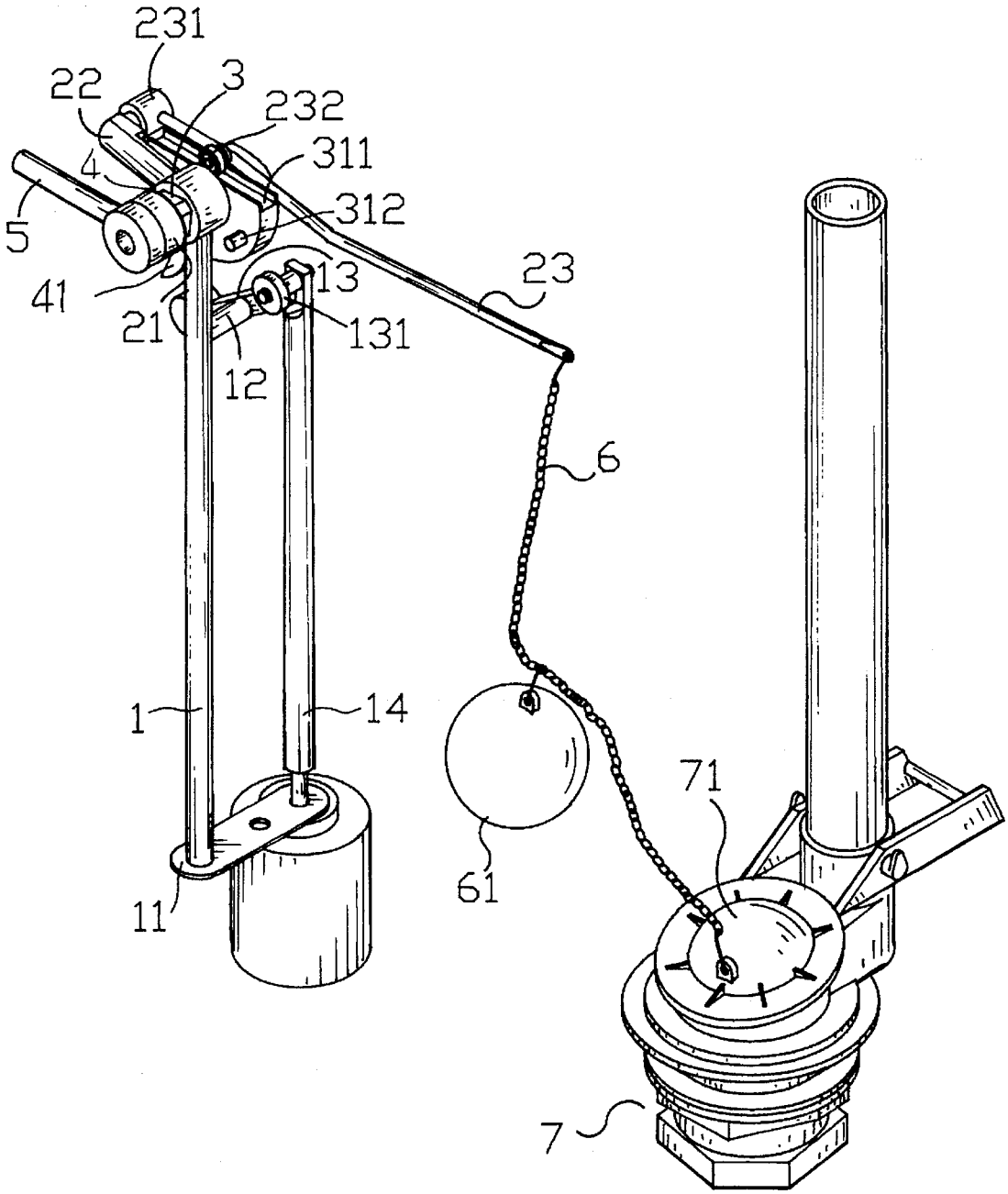
FIG. 2 is an installed perspective view showing the link of the bidirectional two-volume flush control mechanism connected to the tank ball of the valve seat by a chain with a float ball.

Referring to FIG. 2, when the aforesaid mechanism is installed in the tank of the toilet, the shaft 3 is partially extended out of the shell of the tank and is coupled with a trip handle 5. The other end (opposite to the socket 231) of the link 23 is connected to the tank ball 71 of the valve seat 7 by a chain 6, which is connected with a float ball 61.

Figure 3:
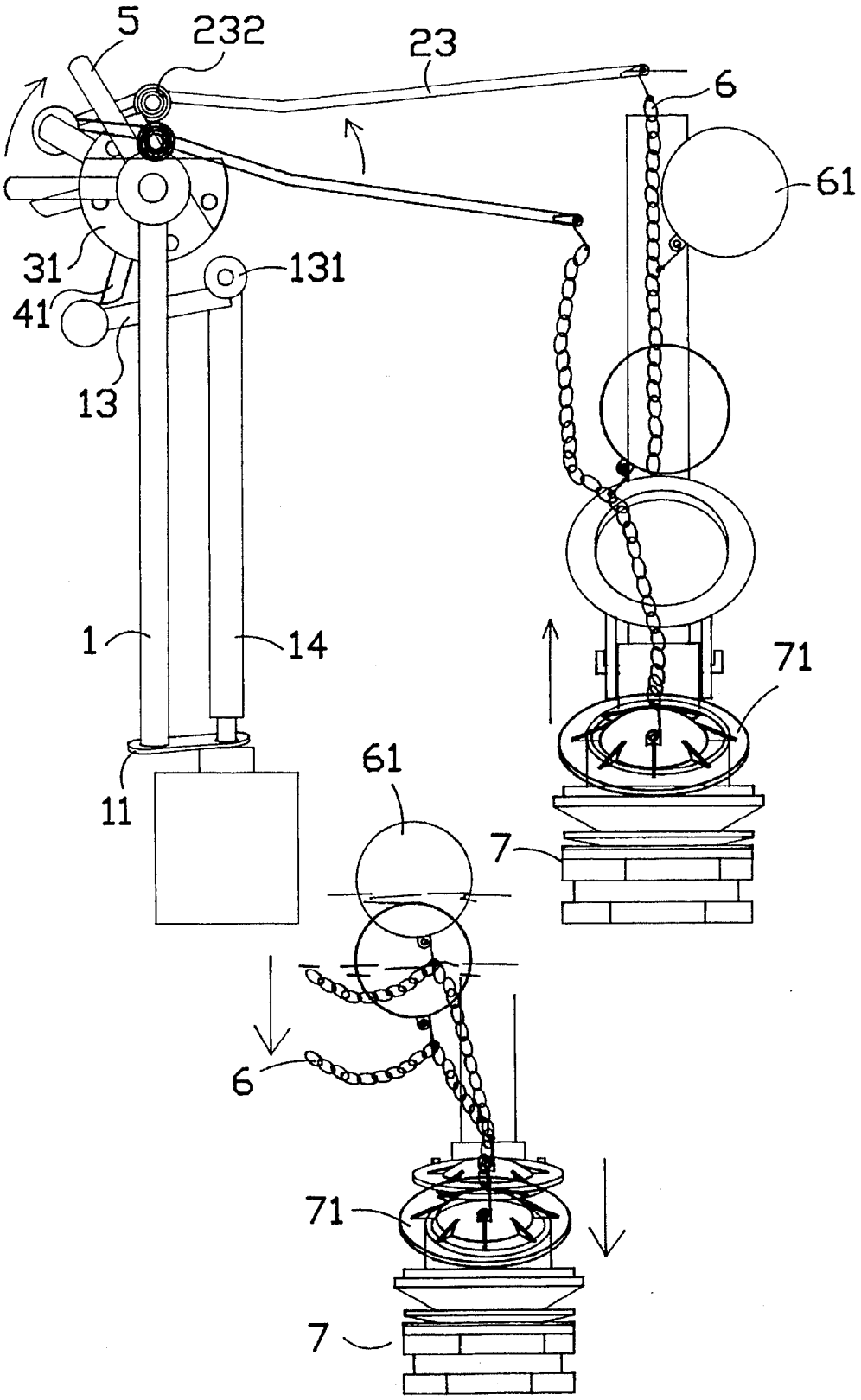
FIG. 3 is an applied view of the bidirectional two-volume flush control mechanism of the present invention, showing the trip handle and the tank ball in a closed position in bold and the trip handle pulled upwards for a partial volume flush control in non-bold lines.

Referring to FIG. 3, when the trip handle 5 is pulled upwards to turn the shaft 3, the bearing 232 of the link 23 is forced to move upwards along the groove 311 on the semi-circular member 31, causing the link 23 to lift the tank ball 71 from the valve seat 7, and therefore water passes out of the tank through the valve seat 7. When the water level drops, the float ball 61 moves downwards with water. When the water level keeps falling, the buoyancy of the float ball 61 becomes eliminated from the tank ball 71, causing the tank ball 71 to be sucked down by the outward flow of water to close the valve seat 7 again. The aforesaid procedure is the half-volume flush control. The output volume of the half-volume flush control can be adjusted by changing the position of the float ball 61 on the chain 6.

Figure 4:
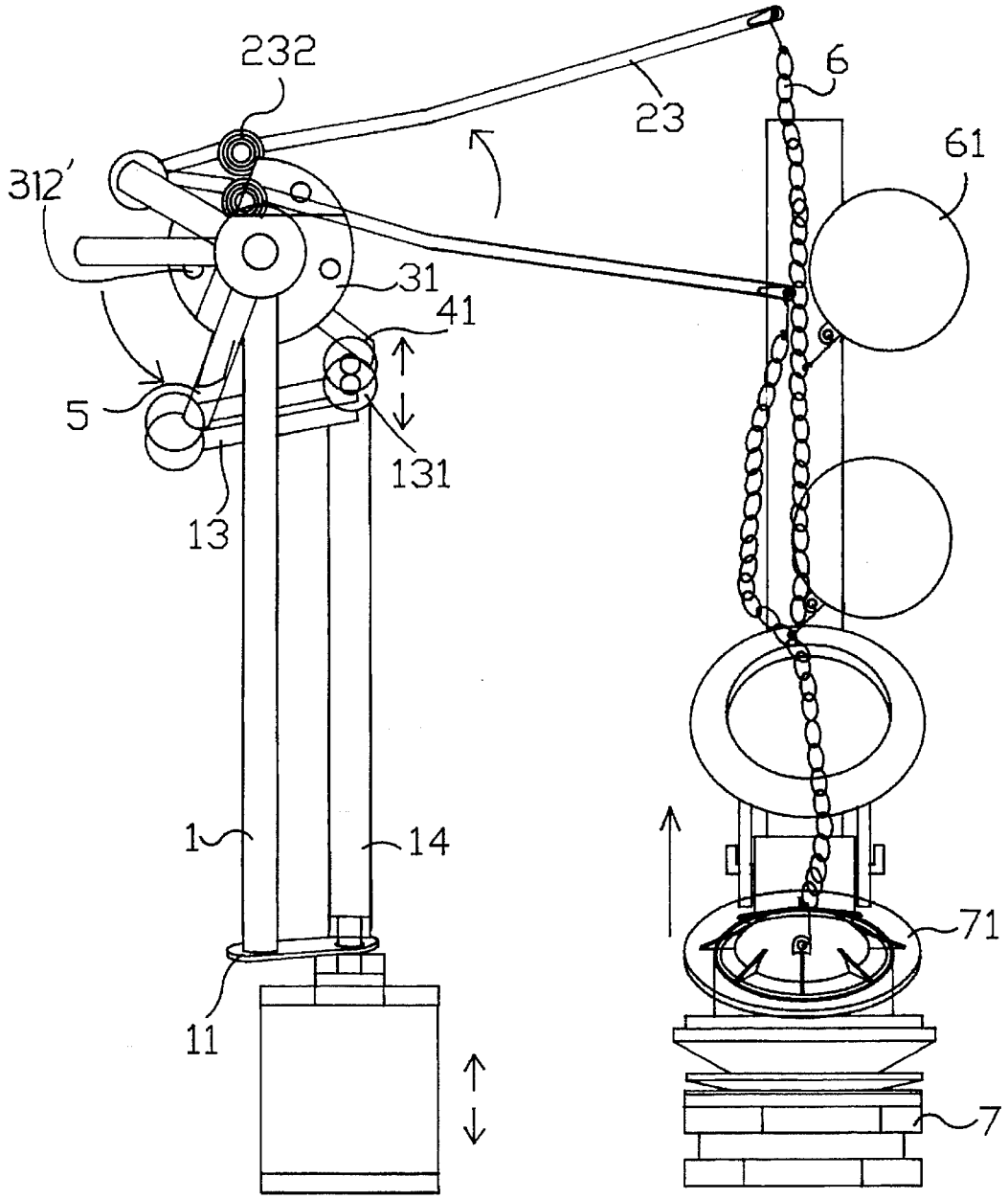
FIG. 4 is another applied view of the bidirectional two-volume flush control mechanism of the present invention, showing the trip handle turned downwards in non-bold lines for a full volume flush control.
Figure 5:
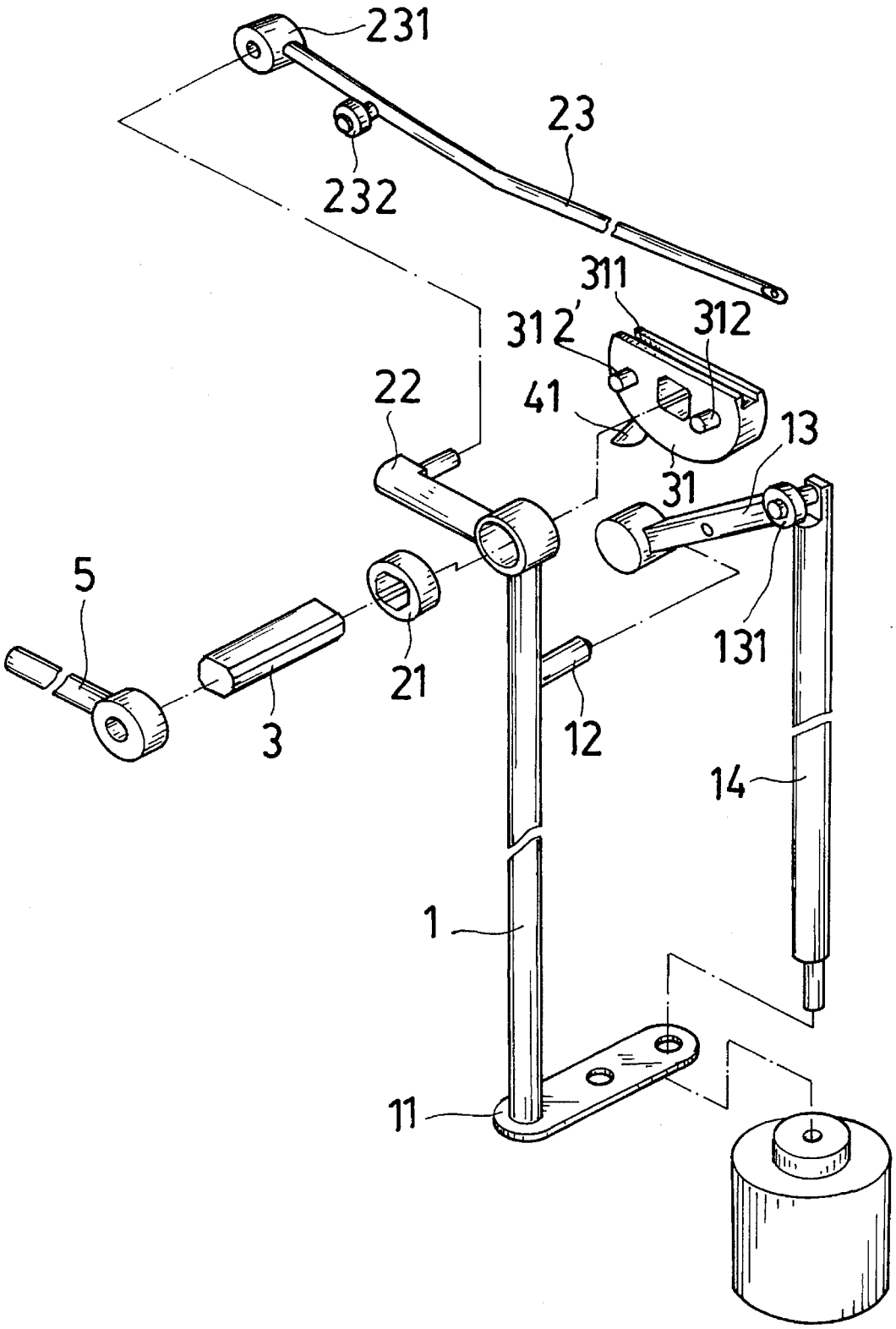
FIG. 5 is an exploded perspective view of the control mechanism shown in FIG. 1.
Figure 6:
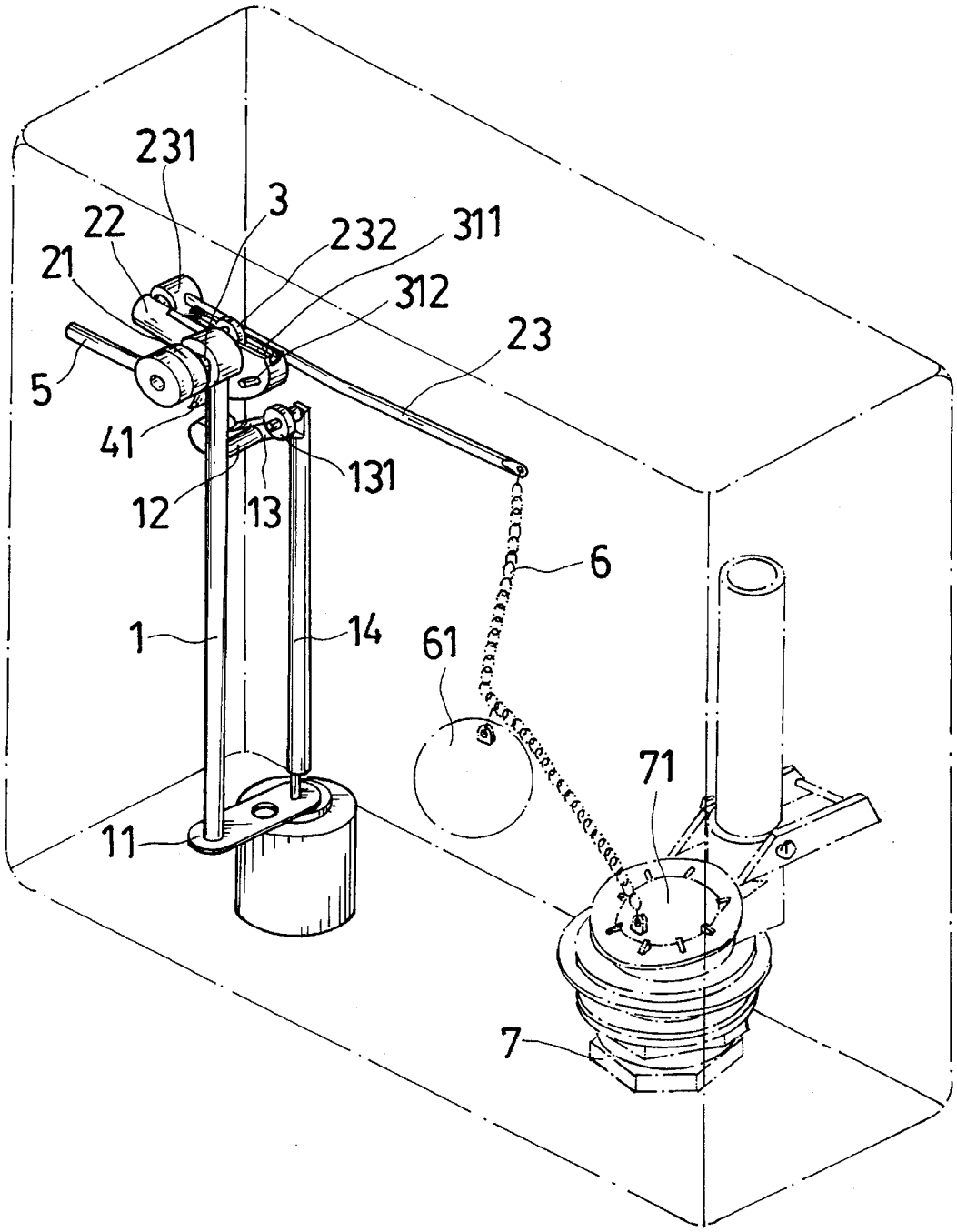
FIG. 6 is a perspective view of the instant control mechanism installed in a water tank.

The full-volume control of the flush control mechanism is outlined hereinafter with reference to FIG. 4. When the trip handle 5 is turned downwards, the bearing 232 of the link 23 is forced to move upwards along the groove 311 on the semi-circular member 31 until one stop rod 312' is stopped at the upright post 1, therefore the link 23 is turned upwards to lift the tank ball 71 from the valve seat 7, permitting water to pass out of the tank through the valve seat 7. At the same time, the rounded actuating tip 41 is moved over the roller 131 to force the cylindrical float 14 downward. After the rounded actuating tip 41 passes over the roller 131, the cylindrical float 14 moves upwards, causing the roller 131 to hold the rounded actuating tip 41 of the actuating rod 4, and therefore the tank ball 71 is retained fully opened. After water has been completely drawn away form the tank, the cylindrical float 14 falls, permitting the rounded actuating tip 41 to pass over the roller 131. When the rounded actuating tip 41 passes over the roller 131 to its former position, the link 23 is returned to its former position, and the tank ball 71 closes the valve seat 7 again.

Furthermore, the tank ball 71 has a flat bottom side, therefore bubbles will note be gathered at the bottom side of the tank ball 71 when the tank ball 71 is lifted from the valve seat 7 to let water pass out of the tank.

We claim:

1. A bidirectional two-volume flush control mechanism for a toilet having a water tank having a tank ball valve controlling a water outlet comprising:

an upright post installed in the water tank, said upright post having a transverse bottom plate near a bottom end thereof and a peg near a top end thereof, said transverse bottom plate having a through hole;

a cylindrical float assembly disposed in parallel with said upright post, and having a bottom end movably inserted through the through hole in said transverse bottom plate and a top end spaced from said peg;

a swivel rod pivotably connected to said peg, the swivel rod having one end terminating in a weight, an opposite end coupled to the top end of said cylindrical float assembly and a roller attached to the opposite end;

a barrel fixed to the top end of said upright post, and having an angle bar extending therefrom;

a link having one end terminating in a socket pivotably coupled to said angle bar, an opposite end connected to the tank ball valve by a chain, and a bearing between the one end and the opposite end;

a float ball secured to said chain;

a shaft having one end extending through said barrel having a semi-circular member attached to a first end of the shaft and a second end extending exteriorly of the tank connected to a trip handle, said semi-circular member having a groove along a chord thereof which receives said bearing of said link, and two stop rods spaced apart and extending from a lateral side of the semi-circular member; and an actuating rod fixed to and extending from said semi-circular member and having an actuating tip, whereby when the trip handle is moved in a first direction to turn the shaft, the bearing of the link moves along the groove in a first direction causing the link to lift the tank ball valve from its valve seat allowing water to pass out of the tank through the valve such that downward movement of the float ball with the water level causes the tank ball to close the valve seat to achieve a half-volume flush control, and when the trip handle is turned in a second direction, the bearing of the link moves in a second direction along the groove until one stop rod contacts the upright post causing the link to lift the tank ball from the valve seat, permitting water to pass out of the tank through the valve seat, while such turning of the trip handle causes the rounded actuating tip to move over the roller to force the cylindrical float assembly downward, the buoyancy of the cylindrical float causing the roller to hold the rounded actuating tip of the actuating rod, and therefore the tank ball fully opened, after water has been completely drained from the tank, the cylindrical float falls, permitting the rounded actuating tip to pass over the roller enabling the link to return to its initial position, and the tank ball to close the valve seat.

2. The bidirectional two-volume flush control mechanism of claim 1 wherein said tank ball has a flat bottom side.

* * * * *